US006390410B1

(12) United States Patent
LaCount et al.

(10) Patent No.: US 6,390,410 B1
(45) Date of Patent: May 21, 2002

(54) VERSATILE PAPER ROLL HOLDER AND DISPENSER

(75) Inventors: Kenneth H. LaCount, Watersmeet, MI (US); Alan P. Paal, New Franken; Alan J. Pierquet, Green Bay, both of WI (US)

(73) Assignee: Alwin Manufacturing Company, Greenbay, WI (US)

( * ) Notice: Subject to any disclaimer, the term of this patent is extended or adjusted under 35 U.S.C. 154(b) by 0 days.

(21) Appl. No.: 09/158,262

(22) Filed: Sep. 22, 1998

(51) Int. Cl.[7] ..... B65H 75/24; B65H 16/06

(52) U.S. Cl. ..... 242/571.5; 242/596.3; 242/596.7

(58) Field of Search ..... 242/571.5, 571.4, 242/596, 596.3, 596.7

(56) References Cited

U.S. PATENT DOCUMENTS

| | | | | |
|---|---|---|---|---|
| 2,101,531 | A | * | 12/1937 | Clemson |
| 2,482,871 | A | * | 9/1949 | Rapport |
| 2,613,041 | A | * | 10/1952 | Cantrell |
| 3,228,519 | A | * | 1/1966 | Dong et al. |
| 3,584,817 | A | * | 6/1971 | Bolger |
| 3,620,468 | A | * | 11/1971 | St. Amour |
| 3,841,576 | A | * | 10/1974 | Farrer |
| 4,032,077 | A | * | 6/1977 | Baselice |

FOREIGN PATENT DOCUMENTS

| | | | | |
|---|---|---|---|---|
| CA | 517706 | * | 10/1955 | ..... 242/596 |
| GB | 270203 | * | 5/1927 | ..... 242/596 |
| JP | 0015344 | * | 1/1985 | ..... 242/571.5 |

OTHER PUBLICATIONS

Photographs of a paper roll holder sold by Alwin Mfg. Co. prior to Sep. 22, 1997.

* cited by examiner

*Primary Examiner*—Donald P. Walsh
*Assistant Examiner*—William A. Rivera
(74) *Attorney, Agent, or Firm*—Emrich & Dithmar

(57) ABSTRACT

A paper roll holder for rotatably supporting a paper towel roll having a core with open ends. The holder includes a support structure having first and second attachment portions and two hubs insertable into the core of the paper towel roll for holding the paper towel roll. Each hub is rotatably coupled to an associated attachment portion of the support structure, each hub having a body having an axis and a resilient compressible sidewall having a maximum at rest diameter. The sidewall being radially compressible from the at rest position to a plurality of smaller diameters, whereby the sidewall is insertable into the open end of a plurality of differently sized cores. The paper roll holder can be placed in the housing of a paper towel dispenser.

19 Claims, 2 Drawing Sheets

VERSATILE PAPER ROLL HOLDER AND DISPENSER

BACKGROUND OF THE INVENTION

This invention relates to paper towel dispensers and, in particular, to paper roll holders therefor.

DESCRIPTION OF THE PRIOR ART

Certain prior paper roll holders for paper towel dispensers often had a complicated construction and could only adequately accommodate a single sized diameter core of a paper roll. These holders often included two circular, non-resilient end hubs having a sidewall inserted into the core. Since these hubs were non-resilient, these holders could only accommodate one sized cores. None of the prior art paper roll holders could accommodate paper rolls with various sized cores while maintaining a constant center line relative to the transfer mechanism.

Other holders included an extra piece releasably connected to the two end hubs. Though holders equipped with this piece could accommodate different diameter cores, the holder suffered several problems. First, it did not permit a tight fit with cores having a larger diameter than the end hub. This caused resistance by the larger core dragging on the holder rather than rotating with the holder during dispensing, making dispensing much more difficult. Second, the center line of these larger diameter cores would be moved down from the center of the hubs, which could cause the lower peripheral end of the paper roll to interfere with other portions of the dispenser, such as the transfer mechanism. Third, the extra piece often became lost or misplaced during roll replacement.

SUMMARY OF THE INVENTION

Accordingly, it is a general object of the present invention to provide an improved paper roll holder which avoids the disadvantages of prior paper roll holders while affording additional structural and operational advantages.

An important feature of the present invention is the provision of a paper roll holder which is a relatively simple and economical construction.

A still further feature of the invention is the provision of a holder of the type set forth which can accommodate a range of differently sized paper roll cores.

Another feature of the present invention is the provision of a holder of the type set forth which minimizes drag of the paper roll on the paper roll holder to ease dispensing of the toweling.

Still another feature of the present invention is the provision of the holder of the type set forth which maintains the axes of various size of paper roll cores in the same position in a paper dispenser which prevents interference of the paper roll with other parts of the dispenser.

Certain ones of these and other features of the invention may be obtained by providing a paper roll holder for rotatably supporting a paper towel roll having a core with open ends. The holder includes a support structure having first and second attachment portions and two hubs insertable into the core of the paper towel roll for holding the paper towel roll. Each hub is rotatably coupled to an associated attachment portion of the support structure and includes a body having an axis and a resilient compressible sidewall having a maximum at rest diameter. The sidewall being radially compressible from the at rest position to a plurality of smaller diameters, whereby the sidewall is insertable into the open end of a plurality of differently sized cores.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 2:
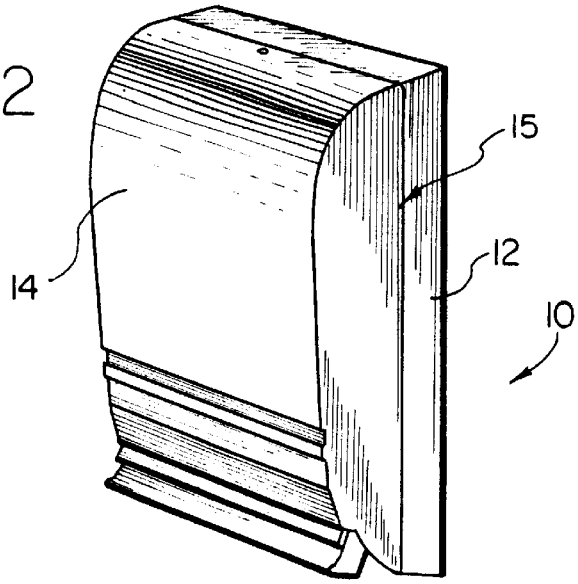
FIG. 2 is a perspective view of the paper towel dispenser of the present invention.
Figure 4:
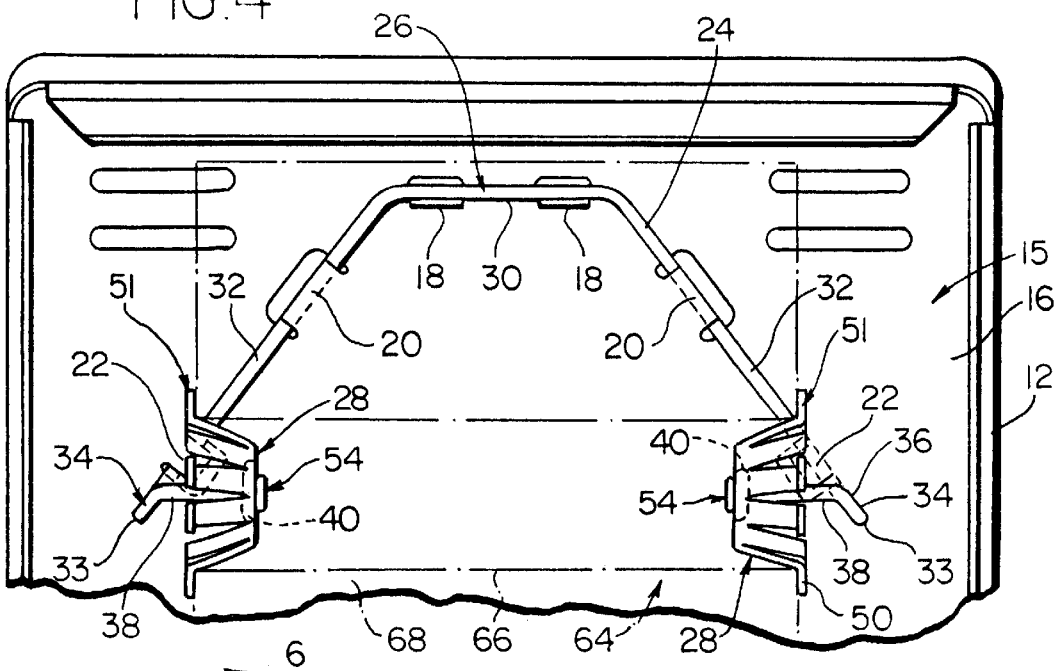
FIG. 4 is an enlarged partial front elevational view of the dispenser shown in FIG. 3 better illustrating the paper roll holder with the paper roll shown in phantom.
Figure 5:
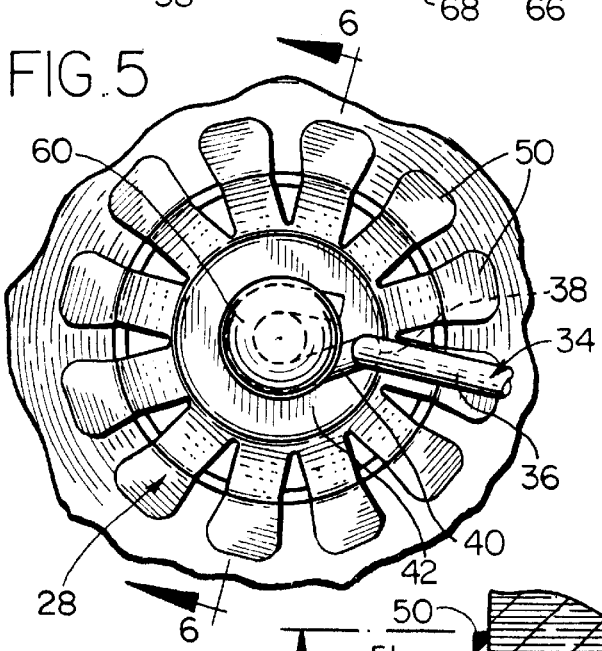
FIG. 5 is a side elevational view of the hub and support structure of the paper roll holder of FIG. 4.

Referring to the drawings, as seen in FIG. 2, a paper towel dispenser 10 is provided. The paper towel dispenser 10 includes a back support structure 12 to connect to a wall or other vertical structure in a known manner and a front cover 14 forming a housing 15. As seen in FIG. 4, the back support structure 12 includes a back wall 16 having two central clips 18, two upwardly facing U-shaped stamped projections 20 and two downwardly U-shaped stamped projections 22. Each of the projections 20 and 22 and the backwall 16 form a channel (four in total).

Still referring to FIG. 4, a paper towel roll holder 24 is disposed in the housing 15. The paper towel roll holder 24 includes support structure, such as a flexible wire rod 26, and two hubs 28 rotatably coupled thereto.

The rod 26 is coupled to the backwall 16. The rod 26 is a one-piece structure having a central portion 30 disposed in the two clips 18. The rod 26 also has two legs 32 each passing through one of the channels formed by upwardly facing U-shaped portions 20 and backwall 16 and one of the channels formed by the downwardly facing U-shaped projection 22 and the backwall 16. The legs 32 and central portion 30 of the rod 26 lie in substantially the same plane.

Each leg 32 of the rod 26 also has a bottom end 33 and a foot 34 connected to the bottom end 33. The foot 34 has a first portion 36 which projects out of the plane of the legs 32 and central portion 30. Each first portion 36 of the foot 34 is also sloped in a direction from the bottom end 33 toward the central portion 30. Each foot 34 also has a second portion 38 connected to the first portion 36. Each second portion 38 is substantially parallel to the central portion 30 and projects inwardly from the first portion 36 toward the opposite foot 34. Each foot 34 also includes a substantially planar loop 40 disposed at the end of the second portion 38. The loops 40 each lie in planes substantially parallel to one another. The loops 40 have an at rest position, as in FIG. 4, where they are separated a minimum distance. As discussed below, when the loops 40 are separated by a greater distance than the minimum at rest distance, the resilient wire rod causes the loops to be biased toward one another back to the at rest position.

Figure 1:
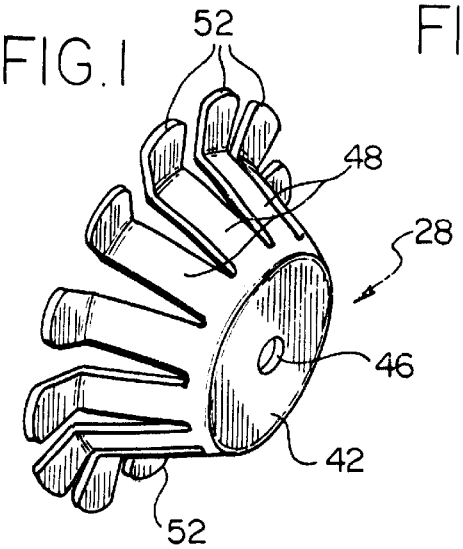
FIG. 1 is a perspective view of the hub of the paper roll holder of the present invention.
Figure 6:
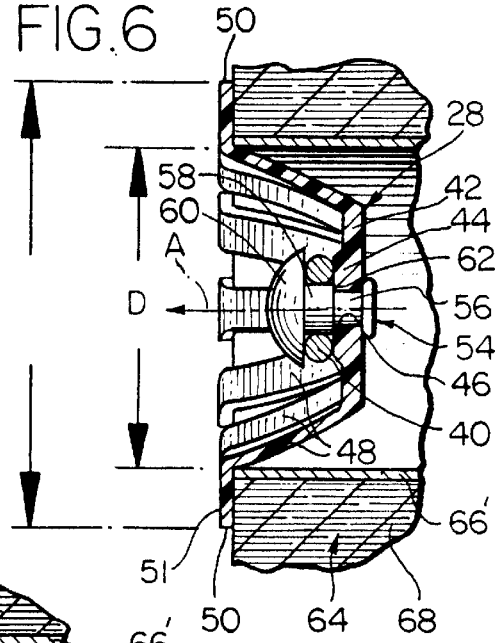
FIG. 6 is a sectional view taken generally along the line 6—6 of FIG. 5.

As seen in FIGS. 1 and 6, each hub 28 of the paper roll holder 24 includes an axis "A", a circular end wall 42 having a thicker central portion 44 (FIG. 6) having an aperture 46. Each hub 28 also includes a plurality of spaced apart legs 48 projecting angularly and radially outwardly from the periphery of the end wall 42. Together the legs 48 and the end wall 42 having a substantially frustoconical shape.

Each hub 28 also includes a plurality of U-shaped branches coupled to an associated leg 48. In its at rest position, as shown in FIG. 1, flanges 50 lie substantially in a plane to form a retaining end wall 51 substantially parallel to end wall 42.

Figure 7:
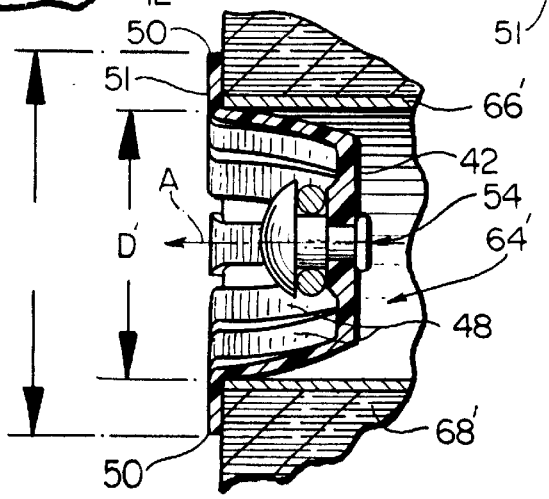
FIG. 7 is a view similar to FIG. 6 where the sidewall of the hub has been compressed to support a small diameter core of the paper roll.

As discussed below, the plurality of legs 48 define a sidewall 52 having a maximum diameter as measured where the legs 48 are connected to the flanges 50. As seen in FIGS. 6 and 7, the ends of the legs 48 of sidewall 52 are advantageously compressible toward the axis "A" (toward a position parallel thereto) to vary the maximum diameter from a non-compressed state (or at rest position) as shown in FIGS. 1 and 6 to a smaller diameter as shown in FIG. 7. In that regard, the legs 48 are flexible, resilient and formed of a flexible material which allows the legs 48 to compress inwardly yet return to their at rest position. Preferably, the legs 48 are formed of a resilient plastic. Preferred plastics include acetals, polyacetals and polypropylene, including those sold under the tradename Celcon® made by Hoechst Celanese Corporation. It is possible that stainless steel could also be used.

As seen best in FIG. 6, the hubs 28 are coupled to the wire 26 by passing a rivet 54, or other suitable connector, through an associated loop 40 of the wire rod 26 and an associated aperture 46 of the end wall 42 of the hub 28. The rivet 54 includes a first cylindrical portion 56 having a diameter substantially equal to the diameter of the aperture 46 and passing therethrough, a larger diameter second cylindrical portion 58 passing through the loop 40, a head 60 and a shoulder 62 formed between the first and second cylindrical portions 56, 58 and resting on the end wall 42. Preferably, the rivet 54 and hub 48 are fixed with respect to one another and rotate together. To allow rotation of the hub 20 and the attached rivet 54, the length of the second cylindrical portion 58 is slightly greater than the diameter of the loop 40 of the wire rod 26 to provide clearance therefrom. When the loops 40 are in their at-rest position, the axes of the two hubs 28 connected to the loops 40 are substantially coaxial.

To provide ease of rotation of the hubs 28 about their respective axes, the end wall 42 is preferably made of a self lubricating, low coefficient of friction material, such as the same plastic forming the legs 48 of the hub 28. Preferably, therefore, the hub 28 is a one-piece molded construction.

Figure 3:
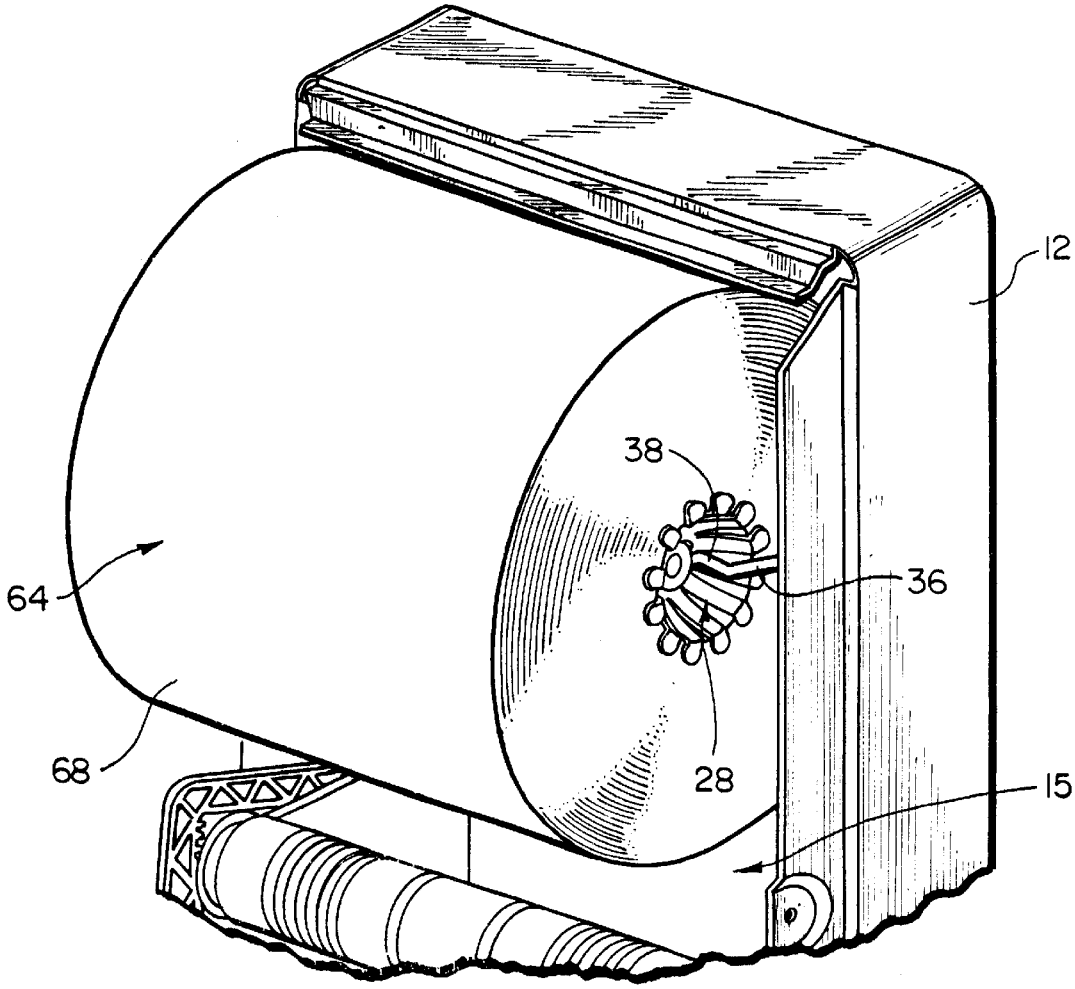
FIG. 3 is an enlarged partial perspective view of the dispenser of FIG. 2 with the front cover removed.

As seen in FIGS. 3 and 4, a paper roll 64 having a cylindrical core 66 and paper toweling 68 disposed thereabout is inserted and held by the paper roll holder 24 as follows. First, one of the loops 40 and connected hub 28 are manually moved away (a greater than the minimum at-rest distance discussed above) from the other connected loop 40 and hub 28. Then, one end of the core 66 is placed over the non-moved hub 28 until the end of the core 66 contacts at least some of the flanges 50 of the retaining end wall 51 of the hub 28. The other end of the core 66 is then aligned and placed over the hub 28 which has been moved. Since the loops 40 are biased towards one another back to the at-rest position, the connected hubs 28 are also so biased and apply pressure to entrap and support the core 66 between the two retaining end walls 51.

As discussed above, the sidewall 52 formed by the legs 48 of the hub 28 are compressible radially inwardly toward the axis of the hub 28 to accommodate and support differently sized paper roll cores. As seen in FIG. 7, a core 66' of a paper roll 64' having a smaller diameter than that of the core 66 of FIG. 6 is supported on hub 28. As seen by the line D' of FIG. 7, the sidewall 52 and legs 48 thereof have been further compressed inwardly to form a smaller maximum diameter sidewall 52 than when the hub 28 is supporting the larger diameter core 66, such as shown in and represented by line D in FIG. 6.

If the diameter of the core 66 is less than the maximum at-rest diameter of the sidewalls 52, the legs 48 of the hub 28 will have been compressed radially inwardly and exert a radial force on the core 66 to form a frictionally engageable fit therebetween. As seen in FIGS. 6 and 7, this frictional fit allows the paper towel roll holder 24 to support and properly position a plurality of differently sized paper roll cores at a position where the axis (or center line) of the paper roll core is substantially coaxial with the axes of the hubs 28.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A paper roll holder for rotatably supporting a paper towel roll having a core with open ends, the holder comprising:

a support structure having first and second attachment portions biased toward one another; and two hubs insertable into the core of the paper towel roll for holding the paper towel roll, each hub rotatably coupled to an associated attachment portion of the support structure, each hub having a body having an axis, a circular end wall having an outer perimeter, and a resilient compressible sidewall angularly projecting away from the perimeter of the endwall, the sidewall having a first end adjacent the endwall having a minimum at rest diameter and a second end away from the endwall having a maximum at rest diameter, the second end of the sidewall being radially compressible from the at rest position to a plurality of smaller diameters, wherein the first ends of the sidewalls of the hubs are separated by a first distance and the second ends of the sidewalls hubs are separated by a second distance which is greater than the first distance, whereby the hub is insertable endwall first into the open end of a plurality of differently sized cores.

2. The holder of claim 1, wherein the sidewall includes a plurality of spaced-apart legs angularly projecting from the end wall, wherein the end wall and sidewall form a substantially frustoconical shape.

3. The holder of claim 2, wherein each of the hubs further comprises a plurality of flanges, each flange coupled to an associated leg, the flanges defining a slotted retaining end wall disposed substantially parallel to the circular end wall.

4. The holder of claim 3, wherein the support structure is a resilient wire rod, the first and second attachment portions respectively include first and second loops, the first and second loops having an engaging position wherein the first and second loops are separated a first distance, wherein when the first and second loops are separated by a distance greater than the first distance, the first and second loops are biased towards one another, each hub respectively coupled to the support structure by a connector passing through an associated loop and the end wall of the associated hub.

5. The holder of claim 4, wherein each of the end walls has an aperture and each of the connectors is a rivet, each rivet having a head, a first diameter portion passing through the aperture of the end wall and a second larger diameter portion connected to the head and the first diameter portion and passing through the loop, each rivets having a shoulder formed between the first and second portions, the second cylindrical portion having a length greater than the diameter of the wire rod.

6. The holder of claim 1, wherein each of the hubs is formed of a resilient plastic.

7. The holder of claim 6, wherein the plastic is selected from the group consisting essentially of acetals, polyacetals, and polypropylene.

8. The holder of claim 7, wherein the hubs are each a one-piece molded construction.

9. The holder of claim 1, wherein the support structure is resilient and the attachment portions are biased towards one another.

10. A paper toweling dispenser comprising:

a housing; and a paper roll holder disposed in the housing for rotatably supporting a paper towel roll having a core with open ends, the holder comprising a support structure having first and second attachment portions biased toward one another, and two hubs insertable into the core of the paper towel roll for holding the paper towel roll, each hub rotatably coupled to an associated attachment portion of the support structure, each hub having a body having an axis, a circular end wall having an outer perimeter, and a resilient compressible sidewall angularly projecting away from the perimeter of the endwall, the sidewall having a first end adjacent the endwall having a minimum at rest diameter and a second end away from the endwall having a maximum at rest diameter, maximum at rest diameter, the second end of the sidewall being radially compressible from the at rest position to a plurality of smaller maximum diameters, wherein the first ends of the sidewalls of the hubs are separated by a first distance and the second ends of the sidewalls hubs are separated by a second distance which is greater than the first distance, whereby the hub is insertable endwall first into the open end of a plurality of differently sized cores.

11. The dispenser of claim 10, wherein the sidewall includes a plurality of spaced-apart legs angularly projecting from the end wall, wherein the end wall and sidewall form a substantially frustoconical shape.

12. The dispenser of claim 11, wherein each of the hubs further includes a plurality of flanges, each flange coupled to an associated leg, the flanges defining a slotted retaining end wall disposed substantially parallel to the circular end wall.

13. The dispenser of claim 12, wherein the support structure is a resilient wire rod, the first and second attachment portions respectively include first and second loops, the first and second loops having an engaging position wherein the first and second loops are separated a first distance, wherein when the first and second loops are separated by a distance greater than the first distance, the first and second loops are biased towards one another, each hub respectively coupled to the support structure by a connector passing through an associated loop and the end wall of the associated hub.

14. The dispenser of claim 13, wherein each of the end walls has an aperture, and each of the connector is a rivet, each rivet having a head, a first diameter portion passing through the aperture of the end wall and a second larger diameter portion connected to the head and the first diameter portion and passing through the loop, each of the rivets having a shoulder formed between the first and second portions, the second cylindrical portion having a length greater than the diameter of the wire rod.

15. The dispenser of claim 10, wherein each of the hubs is formed of a resilient plastic.

16. The dispenser of claim 15, wherein the resilient plastic is selected from the group consisting essentially of acetals, polyacetals, and polypropylene.

17. The dispenser of claim 16, wherein the hubs are each a one-piece molded construction.

18. The dispenser of claim 10, wherein the support structure is resilient and the attachment portions are biased towards one another.

19. The dispenser of claim 10, wherein the hubs have an engaging position where the hubs are substantially coaxial with one another and are friction fittable with a plurality of different sized cores having diameters substantially equal to or less than the maximum at rest diameter, whereby each of the differently sized cores is supported on the hubs at a position such that its axis is substantially coaxial with the hub axes.

* * * * *